US011614081B2

(12) United States Patent
Wackwitz et al.

(10) Patent No.: US 11,614,081 B2
(45) Date of Patent: Mar. 28, 2023

(54) PORTABLE AIR COMPRESSOR

(71) Applicant: MILWAUKEE ELECTRIC TOOL CORPORATION, Brookfield, WI (US)

(72) Inventors: Jeffrey M. Wackwitz, Waukesha, WI (US); Troy C. Thorson, Cedarburg, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 0 days.

(21) Appl. No.: 16/404,048

(22) Filed: May 6, 2019

(65) Prior Publication Data

US 2019/0338763 A1 Nov. 7, 2019

Related U.S. Application Data

(60) Provisional application No. 62/667,976, filed on May 7, 2018.

(51) Int. Cl.

| | |
|---|---|
| ***F04B 39/12*** | (2006.01) |
| ***F04B 35/04*** | (2006.01) |
| ***F04B 39/00*** | (2006.01) |
| ***F04B 41/02*** | (2006.01) |
| ***F04B 35/06*** | (2006.01) |

(52) U.S. Cl.

CPC ..... *F04B 39/121* (2013.01); *F04B 35/04* (2013.01); *F04B 35/06* (2013.01); *F04B 39/0027* (2013.01); *F04B 39/0061* (2013.01); *F04B 39/12* (2013.01); *F04B 41/02* (2013.01)

(58) Field of Classification Search

CPC ..... F04B 35/04; F04B 35/06; F04B 41/02; F04B 39/121; F04B 39/12; F04B 39/0061; F04B 39/0027

USPC ..... 417/234

See application file for complete search history.

(56) References Cited

U.S. PATENT DOCUMENTS 4,389,166 A * 6/1983 Harvey ..... F04B 35/04 417/234
4,988,268 A * 1/1991 Kurihara ..... F04B 39/123 181/246
6,146,108 A * 11/2000 Mullendore ..... F04B 23/00 417/234

(Continued)

FOREIGN PATENT DOCUMENTS

DE 29516321 U1 12/1995
JP 2002180971 A 6/2002

(Continued)

OTHER PUBLICATIONS

Chinese Patent Office Action for Application No. 201920649522.2 dated Dec. 23, 2019 (2 pages including statement of relevance).

(Continued)

*Primary Examiner* — Peter J Bertheaud
(74) *Attorney, Agent, or Firm* — Michael Best & Friedrich LLP

(57) ABSTRACT

An air compressor includes a compressor assembly having an electric motor and a pump driven by the motor, a battery pack electrically connected to the motor for providing electrical power thereto, a storage tank that receives compressed air from the pump, and a case enclosing at least the compressor assembly and the storage tank. The case attenuates noise emitted by the compressor assembly.

16 Claims, 6 Drawing Sheets

(56) References Cited

U.S. PATENT DOCUMENTS

| | | | | |
|---|---|---|---|---|
| 6,773,132 | B2 * | 8/2004 | Gilligan | B25B 21/00 152/416 |
| 7,491,264 | B2 * | 2/2009 | Tao | B01D 53/0446 96/121 |
| 8,079,824 | B2 * | 12/2011 | Chou | F04B 41/06 417/7 |
| 8,282,363 | B2 * | 10/2012 | Ohi | F04B 35/06 417/234 |
| 2005/0214136 | A1 * | 9/2005 | Tsai | F04B 41/02 417/410.1 |
| 2006/0108970 | A1 | 5/2006 | Leasure et al. | |
| 2009/0110566 | A1 * | 4/2009 | Lucchi | F04B 35/06 417/234 |
| 2011/0182754 | A1 * | 7/2011 | Gathers | F16M 3/00 417/234 |
| 2015/0377230 | A1 | 12/2015 | Chou | |

FOREIGN PATENT DOCUMENTS

| | | | |
|---|---|---|---|
| JP | 2007040289 | A | 2/2007 |
| JP | 2009174490 | A | 8/2009 |
| JP | 2013231379 | A | 11/2013 |

OTHER PUBLICATIONS

European Patent Office Partial Search Report for Application No. 19173099.3 dated Sep. 24, 2019 (12 pages).
European Patent Office Extended Search Report for Application No. 19173099.3 dated Mar. 16, 2020 (11 pages).
European Patent Office Action for Application No. 19173099.3 dated Apr. 29, 2022 (5 pages).

* cited by examiner

PORTABLE AIR COMPRESSOR

CROSS-REFERENCE TO RELATED APPLICATIONS

This application claims priority to U.S. Provisional Patent Application No. 62/667,976 filed on May 7, 2018, the entire content of which is incorporated herein by reference.

FIELD OF THE INVENTION

The present invention relates to an air compressor, and more particularly to a portable air compressor.

BACKGROUND OF THE INVENTION

A compressor is a mechanical device that increases the pressure of a gas by reducing its volume. Generally, compressors are used to fill objects, such as vehicle tires, bicycle tires, sports balls, float tubes, and the like, with compressed air. However, such air compressors are usually loud and can be disturbing to the surrounding area.

SUMMARY OF THE INVENTION

The present invention provides, in one aspect, an air compressor including a compressor assembly having an electric motor and a pump driven by the motor, a battery pack electrically connected to the motor for providing electrical power thereto, a storage tank that receives compressed air from the pump, and a case enclosing at least the compressor assembly and the storage tank. The case attenuates noise emitted by the compressor assembly.

The present invention provides, in another aspect, an air compressor assembly including a first case that defines a first interior and a compressor assembly with an electric motor and a pump driven by the motor. The compressor assembly is disposed within the interior of the first case. The compressor assembly also includes a second case coupled to the first case. The second case defines a second interior. The compressor assembly also includes at least one storage tank disposed within either the first interior or the second interior. The storage tank is operable to store compressed air from the compressor assembly.

The present invention provides, in a further aspect, a system including an air compressor with a compressor assembly having an electric motor and a pump driven by the motor, a battery pack electrically connected to the motor for providing electrical power thereto, a storage tank that receives compressed air from the pump, and a case that encloses at least the compressor assembly and the storage tank. The system further includes a pneumatic tool stored within the case and an air hose stored within the case for fluidly connecting the pneumatic tool to the storage tank.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
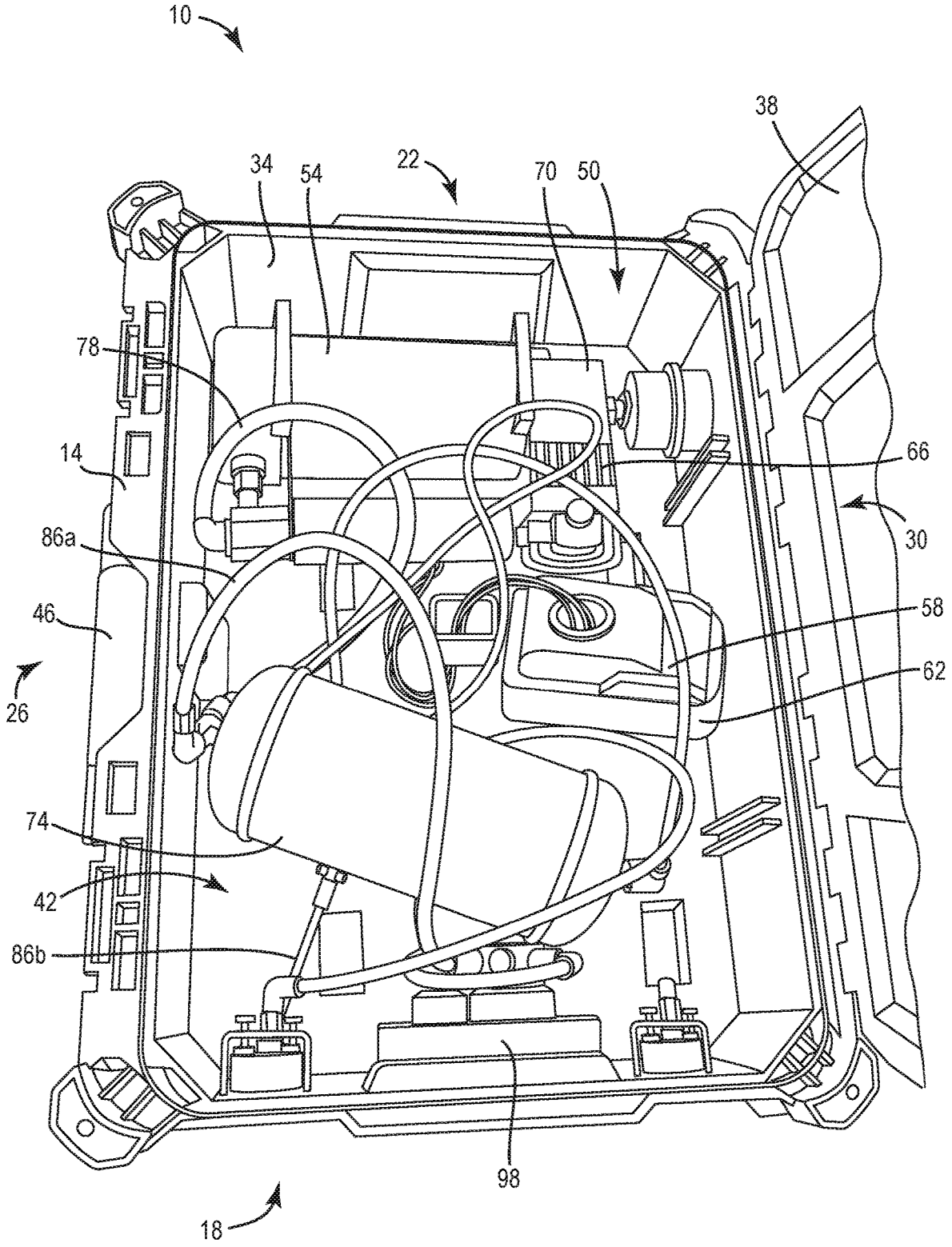
FIG. 1 is a top view of a portable air compressor in accordance with an embodiment of the invention.
Figure 2:
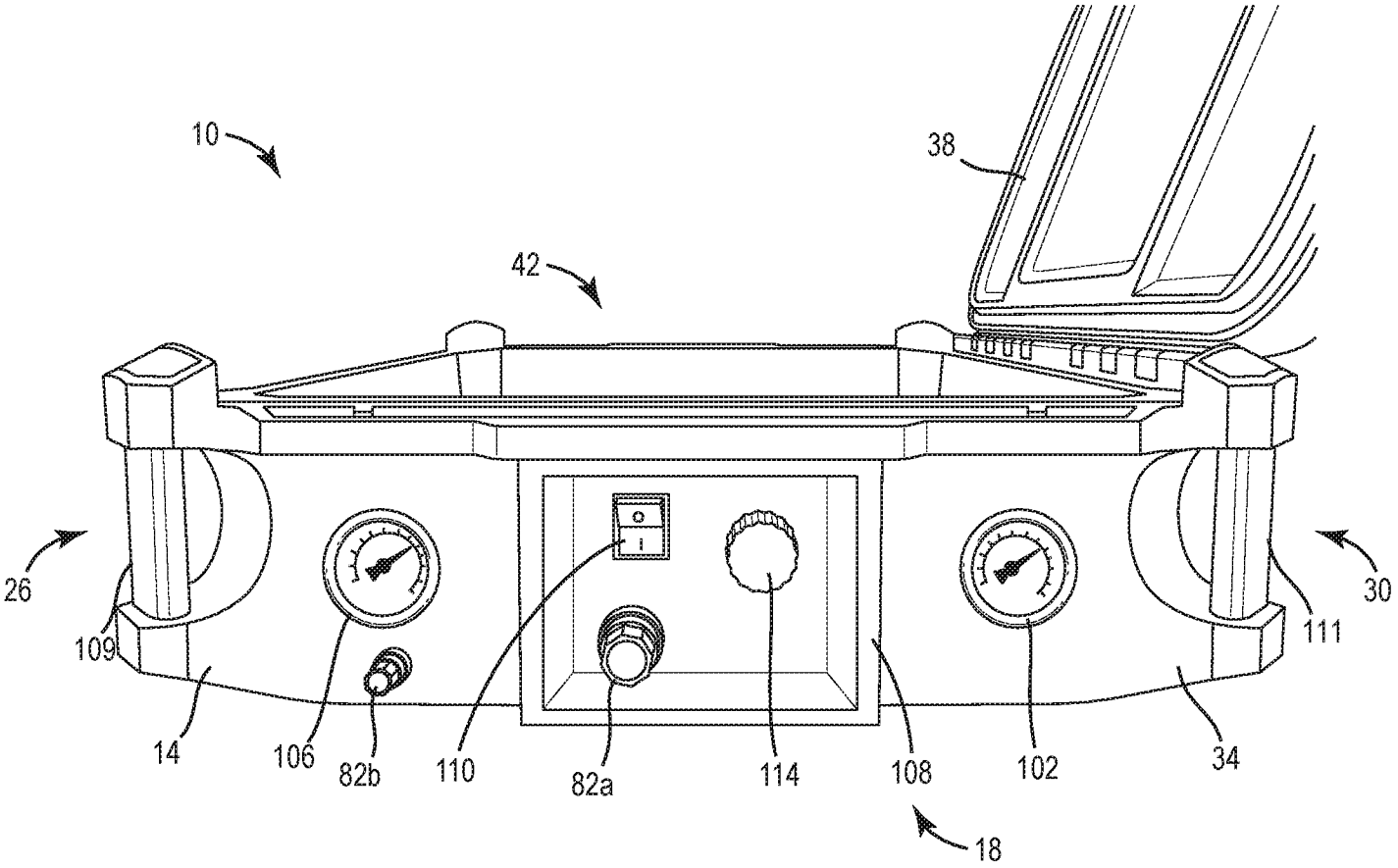
FIG. 2 is a side view of the air compressor of FIG. 1.

FIGS. 1 and 2 illustrate a portable air compressor 10 including a housing (e.g., a case 14) having a front side 18, a rear side 22 (FIG. 1), and left and right sides 26, 30. The illustrated case 14 includes a base 34 and a lid 38 that is selectively openable by a user to allow access to an interior 42 of the case 14 (FIG. 2). The case 14 further includes a handle 46 (FIG. 1) on the left side 26 to facilitate transporting the compressor 10 when the lid 38 is closed. In some embodiments, the case 14 is made from a sound dampening material that attenuates the noise emitted by the compressor 10 while being operated.

Figure 3:
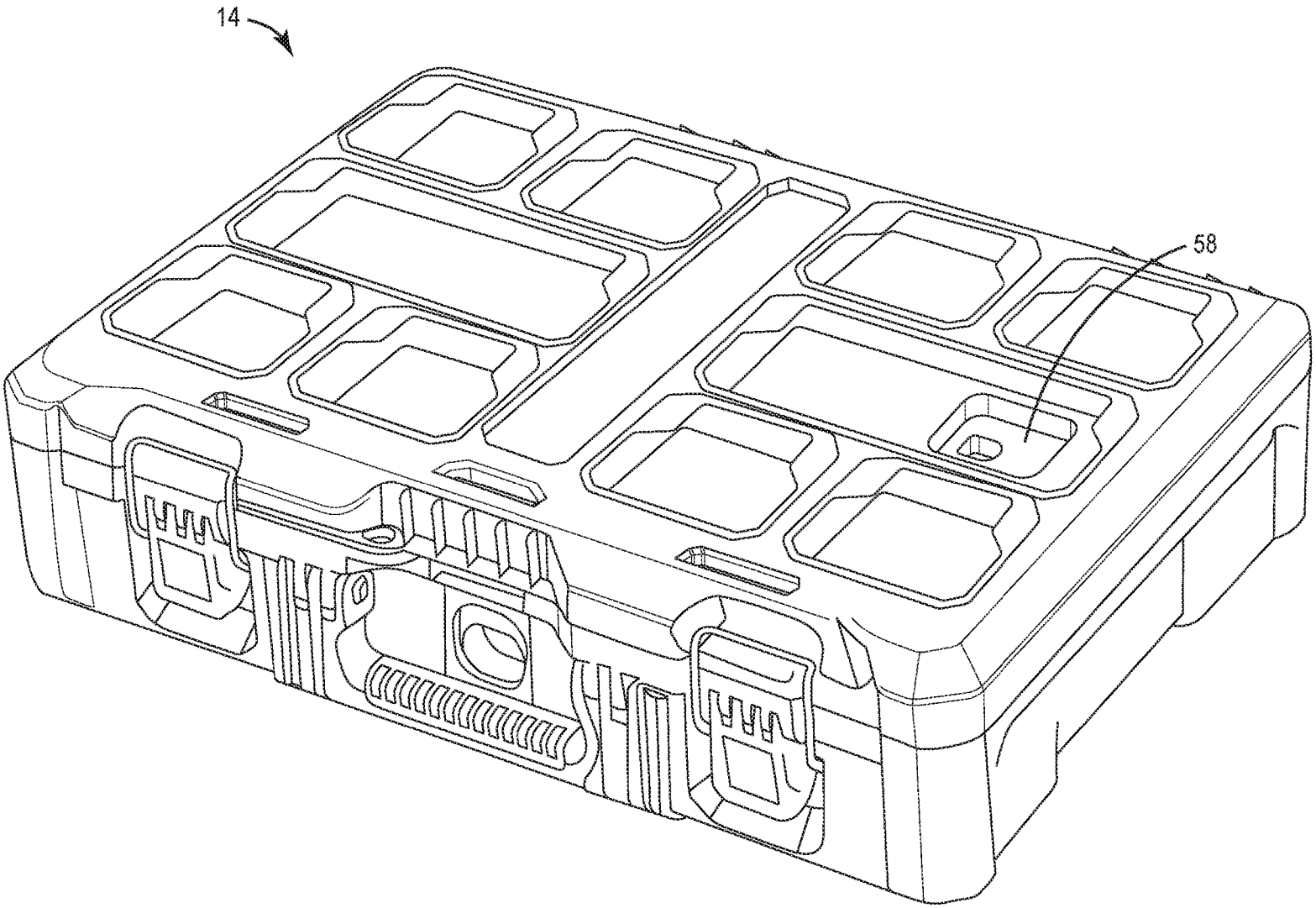
FIG. 3 is a perspective view of an air compressor according to another embodiment of the invention.

With reference to FIG. 1, the compressor 10 includes a compressor assembly 50 and a battery receptacle 58, each of which is located within the interior 42 of the case 14. A battery 62 is removably coupled to the battery receptacle 58 to provide electrical power to an electric motor 54, which is a component of the compressor assembly 50. The illustrated battery 62 is a power tool battery pack with a plurality of rechargeable battery cells (e.g., lithium-based battery cells; not shown) providing the battery with a nominal output voltage of about 18V. In other embodiments, the battery 62 can have a different nominal voltage, such as, for example, 12V, 36V, or 40V. Alternatively, the compressor 10 may include a power cord connectable with a wall outlet or other AC power source, such as an inverter generator. As shown in FIG. 3, in some embodiments, the battery receptacle 58 may be located on the exterior of the case 14, allowing a user to change the battery 62 without opening the lid 38.

With reference to FIG. 1, the compressor assembly 50 further includes a pump 66 that is driven by the motor 54, which in the illustrated embodiment is a DC electric motor and may be a brushed or brushless. The pump 66 is a single-piston reciprocating pump 66 that pressurizes ambient air at atmospheric pressure for storage in a storage tank 74 (via a hose 78), which is also enclosed in the interior 42 of the case 14. In other embodiments, the pump 66 may be a multi-piston reciprocating pump (i.e., more than one piston). The storage tank 78 holds the compressed air until it is needed.

The compressor 10 also includes a pressure regulator 98 in communication with the compressor assembly 50. A portion of the pressure regulator 98 is enclosed within the interior 42 of the case 14. The storage tank 74 is in fluid communication with the pressure regulator 98 via hose 86*a*. The compressor 10 further includes two outlet ports—a regulated outlet port 82*a* (FIG. 2) that receives compressed air at a regulated pressure determined by the pressure regulator 98, and an unregulated outlet port 82*b* that receives compressed air directly from the storage tank 74 via hose 86*b*. The outlet ports 82*a*, 82*b* include a quick-disconnect configuration for selective attachment to a flexible air hose. The outlet ports 82*a*, 82*b* are capable of delivering compressed air simultaneously. Alternatively, only one of the outlet ports 82*a*, 82*b* may be usable at a time.

With continued reference to FIG. 2, the compressor 10 includes a first gauge 102 that displays the regulated pressure of the compressed air discharged from the regulated outlet port 82*a*, and a second gauge 106 that displays the pressure within the storage tank 74. Although not illustrated, the compressor 10 may include a pressure switch that detects the pressure within the storage tank 74. If the detected pressure within the storage tank 74 is below a predetermined minimum value, the pressure switch activates the compressor assembly 50 to refill the storage tank 74 until the pressure in the storage tank 74 reaches a predetermined maximum value, at which time the pressure switch deactivates the compressor assembly 50.

As illustrated in FIG. 2, the compressor 10 includes a control panel 108 disposed on the front side 18 of the case 14 having a power button 110 to selectively activate the compressor assembly 50 and an adjustment knob 114. The adjustment knob 114 may be rotated to set the regulated pressure provided by the outlet port 82*a* depending upon the intended use of the discharged compressed air. The regulated outlet port 82*a* extends through the control panel 108. Alternatively, the unregulated outlet port may also extend through the control panel 108.

With continued reference to FIG. 2, the case 14 includes a first mounting rail 109 and a second mounting rail 111. The second mounting rail 111 may be spaced apart from the first mounting rail 109. The first and second mounting rails 109, 111 are configured to mount accessories to the case 14. For example, hooks, tool bins, and extension cords may all be mounted to the case 14 with the mounting rails 109, 111.

Figure 4:
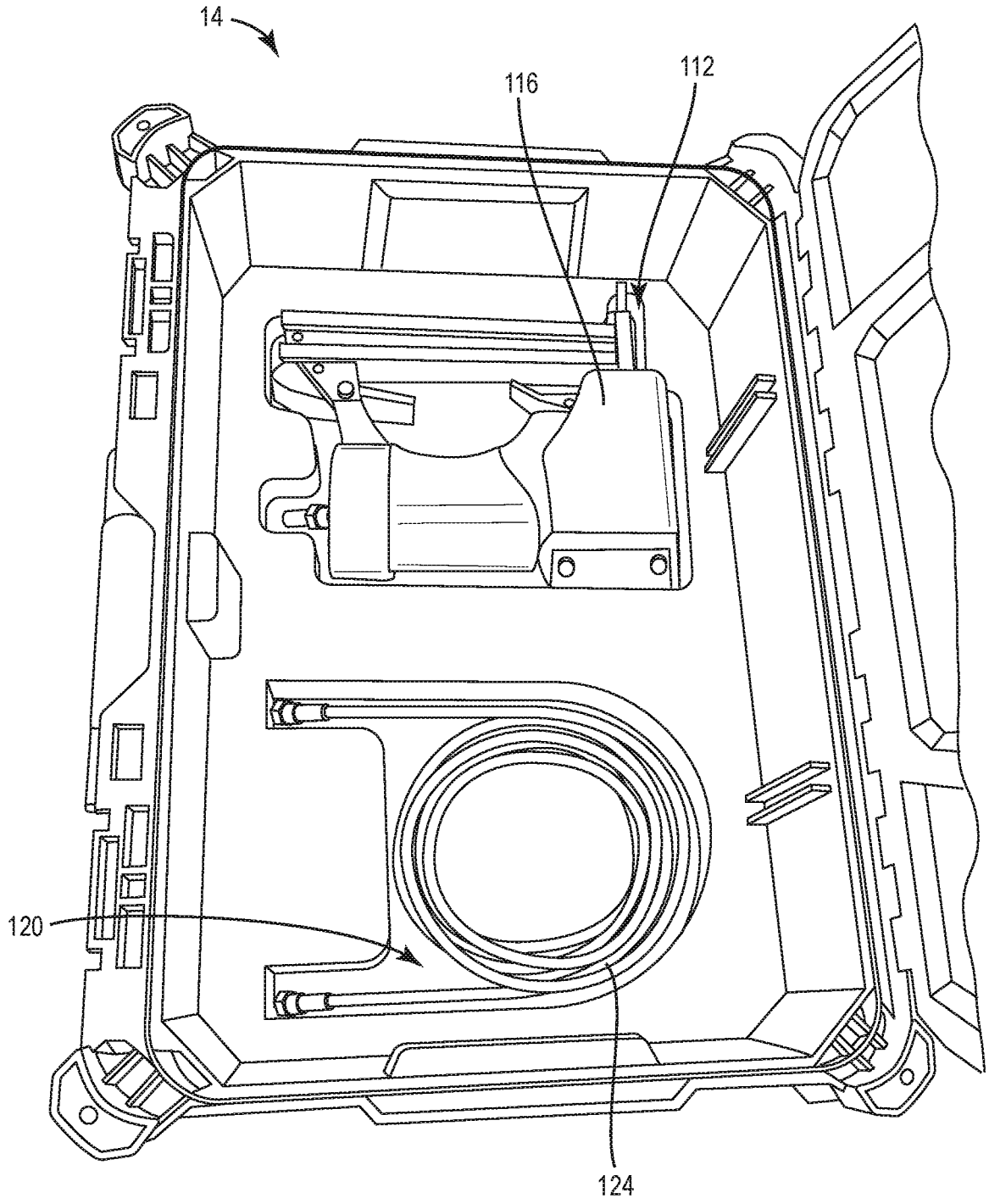
FIG. 4 is a perspective view of an air compressor according to another embodiment of the invention.

In some embodiments, the case 14 may include a storage compartment for a separate tool or device, such as, a hose, a nailer or other accessories. For example, as shown in FIG. 4, the case 14 may include a first recess 112 that receives a pneumatic tool 116. The case 14 may further include a second recess 120 that receives an air hose 124. The air hose 124 fluidly connects the storage tank 74 to the pneumatic tool 116. The pneumatic tool 116 may then be used in conjunction with the compressor 10 as a self-contained system, with the tool 116, the air hose 124, the compressor assembly 50, the battery receptacle 58, and the storage tank 74 being removable from the case 14 to access the tool 116 and hose 124.

Figure 5:
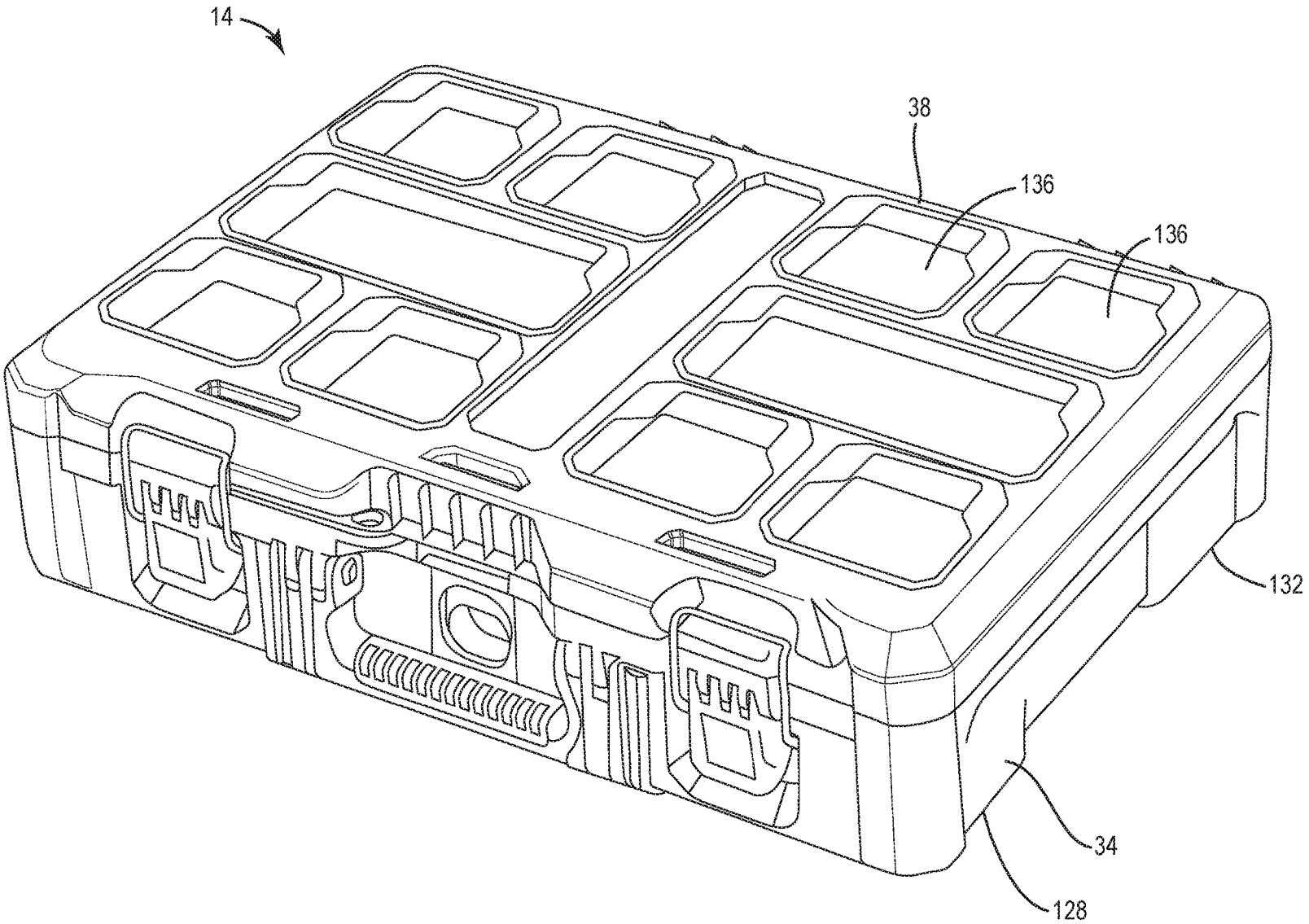
FIG. 5 is a perspective view of a case of the air compressor of FIG. 1.

With reference to FIG. 5, the case 14 includes features on the base 34 and/or the lid 38 that allow the case 14 to be coupled to similar cases having similar features. Such coupling features are described in International Patent Application No. PCT/US2018/044629 filed Jul. 31, 2018, now International Patent Application Publication No. WO 2019/028041, the entire content of which is incorporated herein by reference. For example, the case 14 may include projections 128 on a bottom surface 132 of the base 34. The projections 128 on the case 14 are receivable within recesses 136 on the lid 38 of another case. As such, one or more additional cases can be coupled (e.g., in a stacked arrangement).

Figure 6:
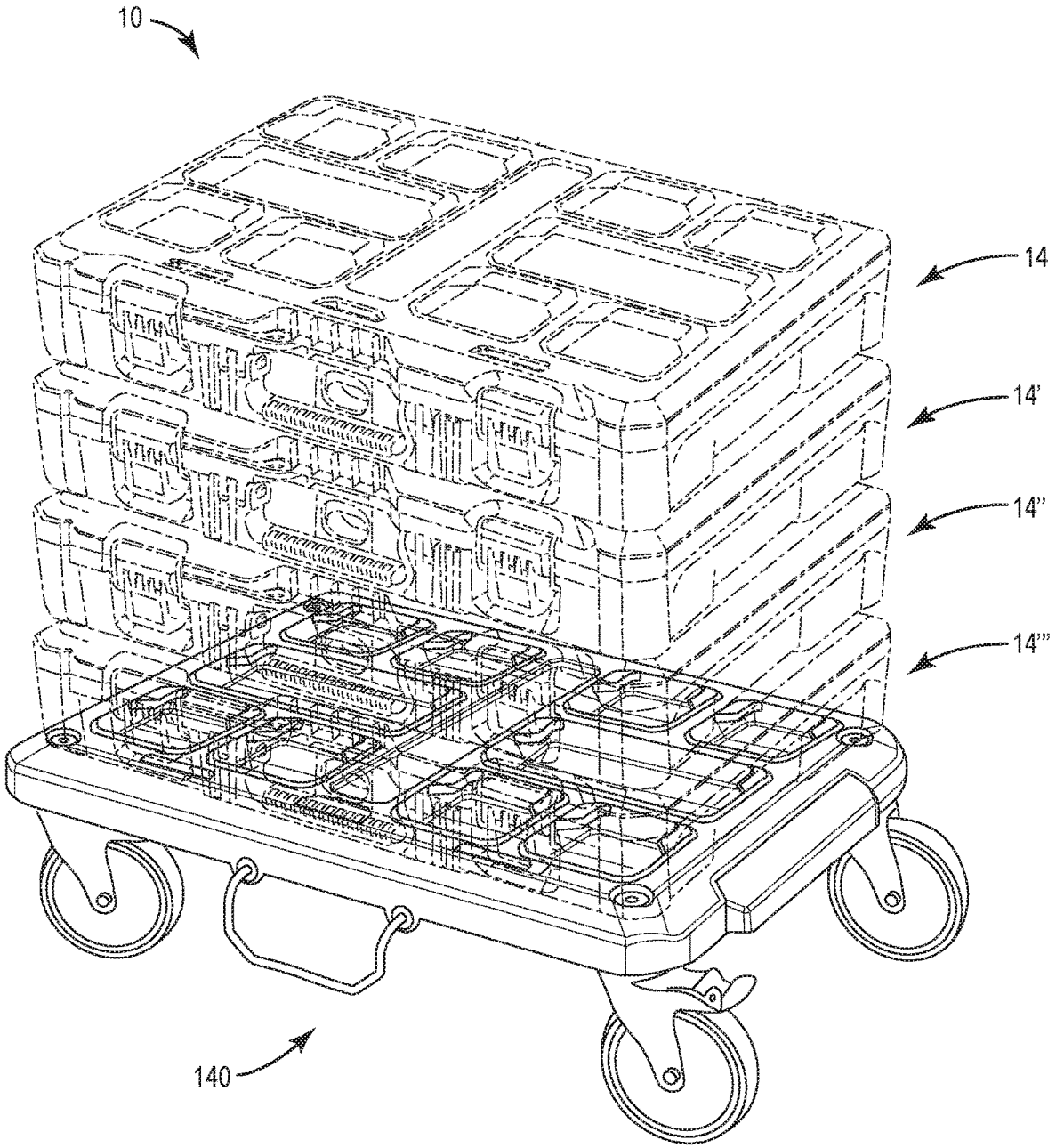
FIG. 6 is a perspective view of multiple cases of FIG. 5.

In a similar manner, additional storage tank modules, each comprising one or more additional storage tanks 74 for storing additional compressed air and enclosed within respective cases identical to the case 14 of the compressor 10, may be fluidly interconnected with one or more compressor modules (i.e., one or more of the compressors 10). For example, the compressor modules and the storage tank modules may be fluidly connected by external hoses or via integrated inlet/outlet ports in the respective cases. The cases of the storage tank modules may also include coupling features, like any of those disclosed in International Patent Application No. PCT/US2018/044629, for connection to the cases 14 of one or more compressor modules to secure the cases of the compressor and storage tank modules together (e.g., in a stacked arrangement). For example, as shown in FIG. 6, a first case 14 may include the compressor assembly 50 and a second case 14' may include the storage tank 74. In addition, a third and fourth case 14", 14'" may include additional storage tanks 74 and/or other accessories for the compressor 10. The multiple cases 14, 14' 14", 14'" may be transported using a wheeled cart 140.

In one embodiment, the case 14 limits the sound produced by the compressor assembly 50 to less than 68 decibels when the lid 38 is closed. In another embodiment, the case 14 limits the sound produced by the compressor assembly 50 to less than 58 decibels when the lid 38 is closed. In further embodiments, the compressor assembly 50 can fill a storage tank 74 having a volume of 0.5 liter, 1 liter, 1.5 liters, or 2 liters with compressed air at a pressure between 75 psi and 125 psi, while producing less than 58 decibels of sound. In some embodiments, the compressor 10 may include a vibration isolation mount between the case 14 and the compressor assembly 50 to further lower the decibels produced by the compressor assembly 50.

In the illustrated embodiment, the case 14 has a low profile that is convenient for carrying. In some embodiments, the case 14 has a width, defined between the left and right sides 26, 30 of the case 14 that is less than 12 inches. In other embodiments, the case 14 has a width that is less than 8 inches. In a further embodiment, the case 14 has a width that is six inches or less.

In further embodiments, the compressor 10 includes a mode selector. The mode selector can select between a performance mode (in which the compressor assembly 50 runs at a higher capacity) and a second mode (in which the compressor assembly 50 runs at a lower capacity and lower sound level).

Various features of the invention are set forth in the following claims.

What is claimed is:

1. An air compressor comprising:

a compressor assembly including an electric motor and a pump driven by the motor;

a battery pack electrically connected to the motor for providing electrical power thereto;

a storage tank that receives compressed air from the pump;

a case entirely enshrouding at least the compressor assembly and the storage tank;

an outlet port in fluid communication with the storage tank;

an adjustable pressure regulator at least partially positioned within the case, the outlet port configured to discharge compressed air from the storage tank at a regulated pressure determined by the pressure regulator; and an adjustment knob to adjust the regulated pressure of compressed air provided by the outlet port, the adjustment knob positioned on an exterior of the case when the case is in a closed configuration;

wherein the case attenuates noise emitted by the compressor assembly; and wherein the case includes one of a projection or a recess configured to engage the other of a projection or a recess of an identical second case to couple the case to the second case.

2. The air compressor of claim 1, wherein the case defines an interior, and wherein the case includes a base and a lid that is selectively openable by a user to allow access to the interior.

3. The air compressor of claim 1, wherein the case includes a handle to facilitate transporting the compressor assembly and the storage tank.

4. The air compressor of claim 1, wherein the pump is a single-piston reciprocating pump.

5. The air compressor of claim 1, wherein the outlet port extends from the exterior of the case.

6. The air compressor of claim 5, wherein the outlet port is a first outlet port and the air compressor further includes a second outlet port in direct fluid communication with the storage tank, wherein the second outlet port is configured to discharge unregulated compressed air from the storage tank.

7. The air compressor of claim 6, further comprising:

a first gauge that displays the regulated pressure of the compressed air discharged from the first outlet port; and a second gauge that displays the pressure within the storage tank.

8. The air compressor of claim 6, wherein the first and second outlet ports are configured to simultaneously discharge compressed air therefrom.

9. The air compressor of claim 1, further comprising a control panel disposed on the case to selectively activate the compressor assembly.

10. The air compressor of claim 1, wherein the battery pack is positioned inside the case.

11. The air compressor of claim 1, wherein the case, when in the closed configuration, attenuates noise produced by the compressor assembly to less than 68 decibels.

12. The air compressor of claim 1, wherein the compressor assembly fills the storage tank with compressed air at a pressure between 75 psi and 125 psi while producing less than 68 decibels of noise with the case closed.

13. The air compressor of claim 1, wherein the case has a width that is less than 12 inches.

14. The air compressor of claim 1, wherein the case includes a first recess to receive a pneumatic tool which is fluidly connected to the storage tank.

15. The air compressor of claim 14, wherein the case further includes a second recess to receive an air hose that fluidly connects the pneumatic tool to the storage tank.

16. An air compressor assembly comprising;

a first case defining a first interior, the first case including a first base and a first lid that is selectively openable by a user to allow access to the first interior;

a compressor assembly including an electric motor and a pump driven by the motor, the compressor assembly disposed within the first interior of the first case;

a second case defining a second interior, the second case including a second base and a second lid that is selectively openable by a user to allow access to the second interior; and at least one storage tank disposed within the second interior, wherein the storage tank is operable to store compressed air from the compressor assembly;

wherein the first case includes a projection that is receivable in a recess of the second case to couple the first and second cases together.

* * * * *